US010199188B2

(12) United States Patent
Terada et al.

(10) Patent No.: US 10,199,188 B2
(45) **Date of Patent: *Feb. 5, 2019**

(54) GAS CIRCUIT BREAKER

(71) Applicant: HITACHI, LTD., Tokyo (JP)

(72) Inventors: Masanao Terada, Tokyo (JP); Yuki Nakai, Tokyo (JP); Yoichi Oshita, Tokyo (JP); Hiroaki Hashimoto, Tokyo (JP); Hajime Urai, Tokyo (JP); Katsuhiko Shiraishi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/547,908

(22) PCT Filed: Jan. 12, 2016

(86) PCT No.: PCT/JP2016/050609

§ 371 (c)(1),
(2) Date: Aug. 1, 2017

(87) PCT Pub. No.: WO2016/125535

PCT Pub. Date: Aug. 11, 2016

(65) Prior Publication Data

US 2018/0025868 A1 Jan. 25, 2018

(30) Foreign Application Priority Data

Feb. 3, 2015 (JP) ..... 2015-018943

(51) Int. Cl.
*H01H 33/42* (2006.01)
*H01H 33/02* (2006.01)
(Continued)

(52) U.S. Cl.
CPC ..... *H01H 33/42* (2013.01); *H01H 3/42* (2013.01); *H01H 3/46* (2013.01); *H01H 2033/028* (2013.01)

(58) Field of Classification Search
CPC ..... H01H 33/42; H01H 33/56; H01H 33/565; H01H 33/44; H01H 33/46; H01H 33/91
(Continued)

(56) References Cited

U.S. PATENT DOCUMENTS 6,271,494 B1 8/2001 Dienemann et al.
8,013,268 B2 * 9/2011 Ozil ..... H01H 33/904 218/155

(Continued)

FOREIGN PATENT DOCUMENTS

JP 2003109480 A 4/2003

OTHER PUBLICATIONS

International Search Report of PCT/JP2016/050609 dated Mar. 22, 2016.

*Primary Examiner* — Renee Luebke
*Assistant Examiner* — William Bolton
(74) *Attorney, Agent, or Firm* — Mattingly & Malur, PC

(57) ABSTRACT

A bidirectional driving mechanism 10 has a drive-side linkage rod 11, a driven-side linkage rod 13, two levers 12 that link the drive-side linkage rod with the driven-side linkage rod, and a guide 14 that regulates the operation of the drive-side linkage rod 11 and the driven-side linkage rod 13. A moveable pin 18 is passed through a first groove cam 16 of the drive-side linkage rod 11, a second groove cam 17 of the guide 14, and third groove cams 19 of the levers 12, and by operation of the drive-side rod 13, the moveable pin 18 moves within the respective groove cams 16, 17, 19, causing the levers 12 to rotate, the driven-side linkage rod 13 to be driven in a direction opposite to the drive-side linkage rod 11, and a driven-side arc electrode 5 to be driven in a direction opposite to a drive-side arc electrode 4.

10 Claims, 5 Drawing Sheets

(51) Int. Cl.
*H01H 3/42* (2006.01)
*H01H 3/46* (2006.01)

(58) Field of Classification Search
USPC .... 218/154, 155, 57, 59, 60, 61, 65, 13, 14, 218/16
See application file for complete search history.

(56) References Cited

U.S. PATENT DOCUMENTS 8,304,677 B2 * 11/2012 Yoon ..... H01H 33/904 218/78
2012/0103940 A1 * 5/2012 Ohda ..... H01H 33/166 218/50

* cited by examiner

[FIG. 1]
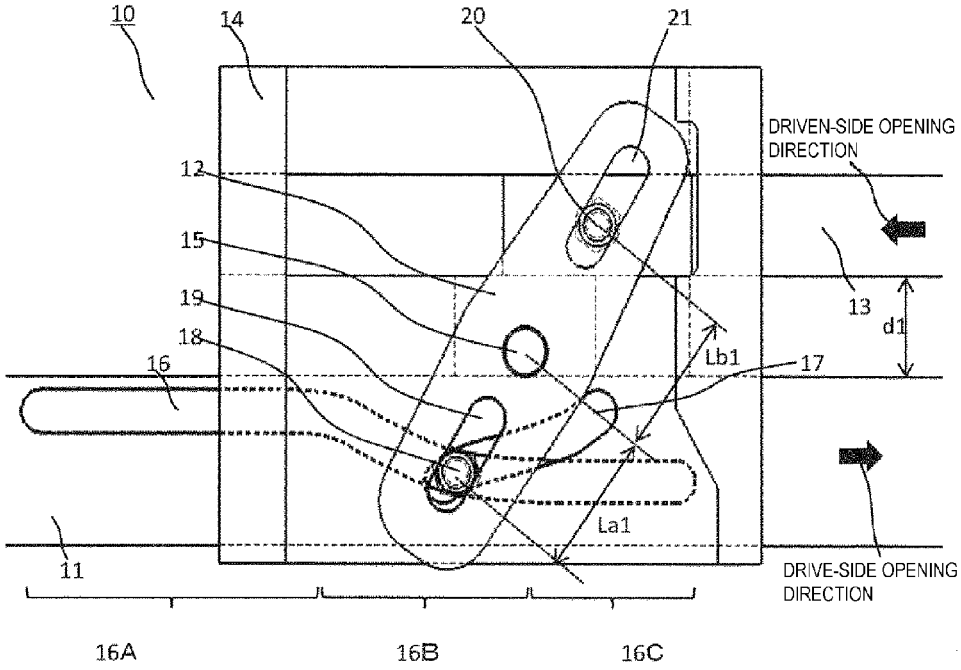
[FIG. 2]
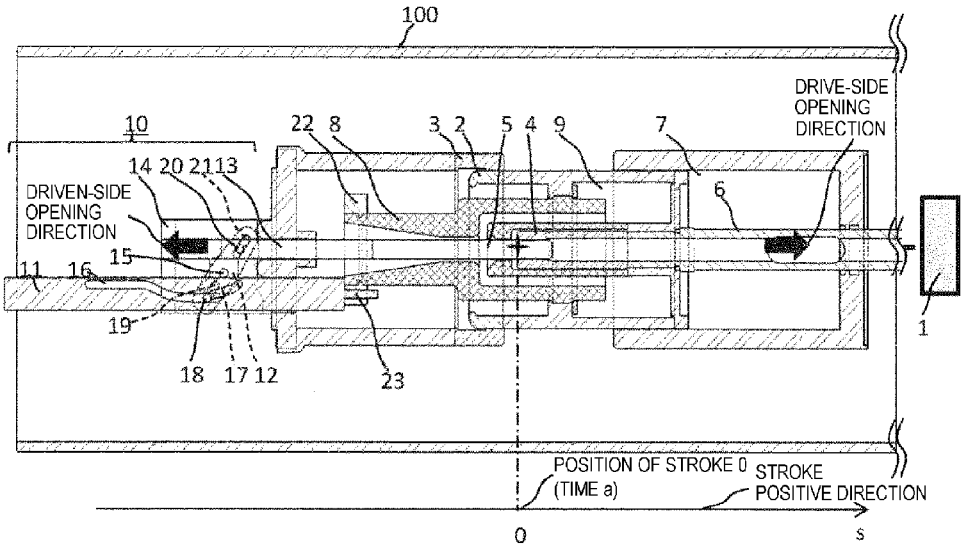

[FIG. 3]
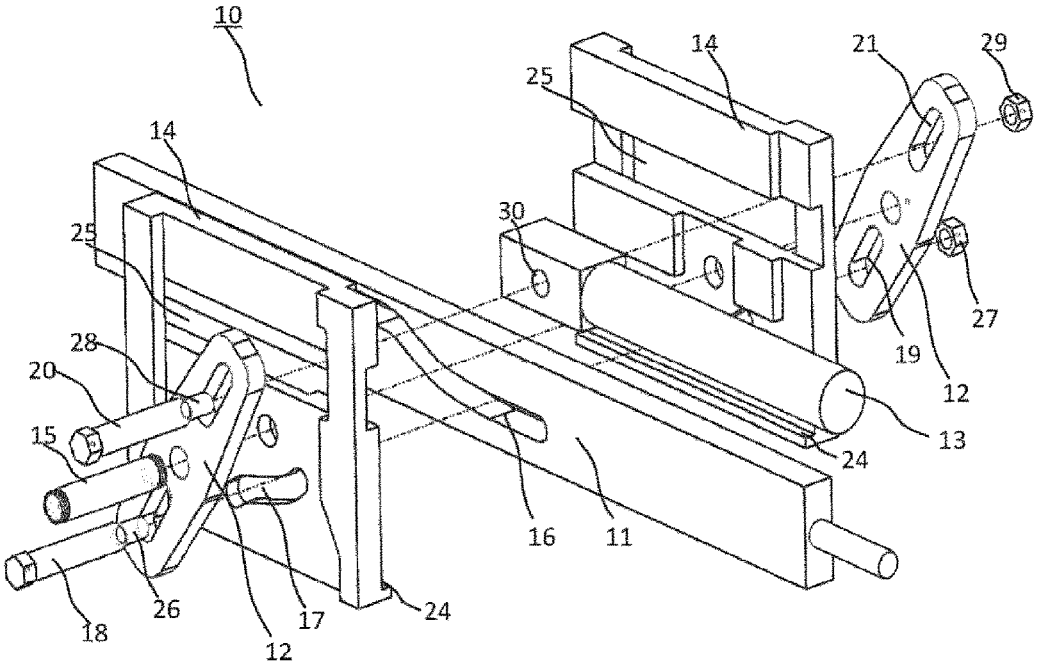
[FIG. 4]
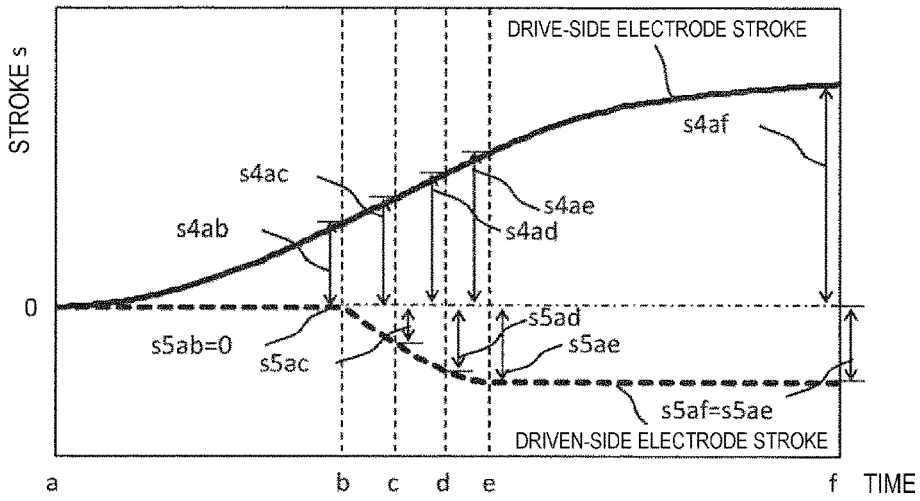

[FIG. 5]
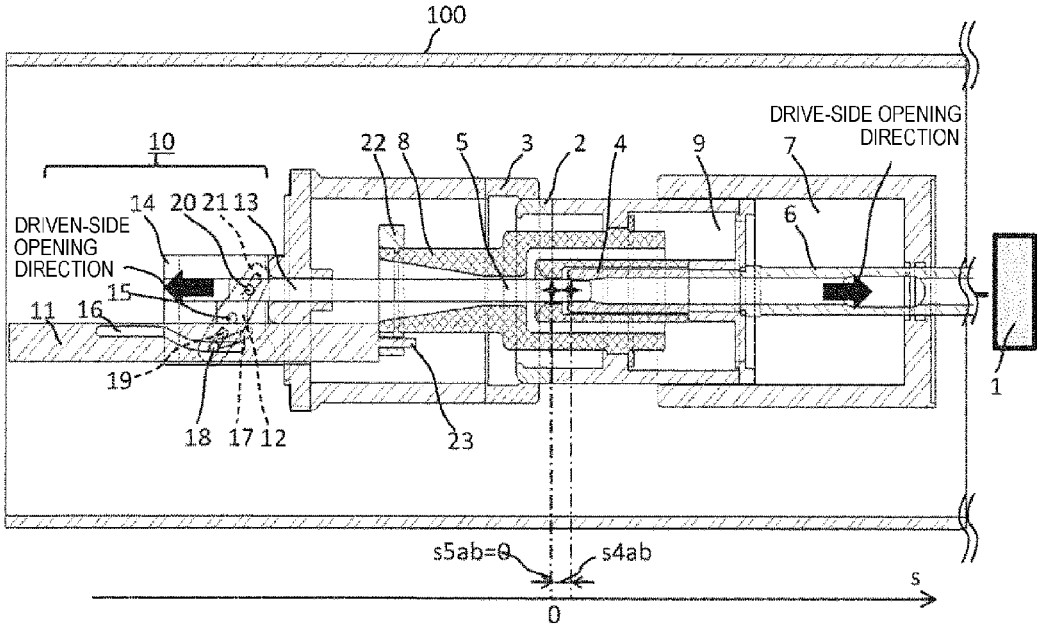
[FIG. 6]
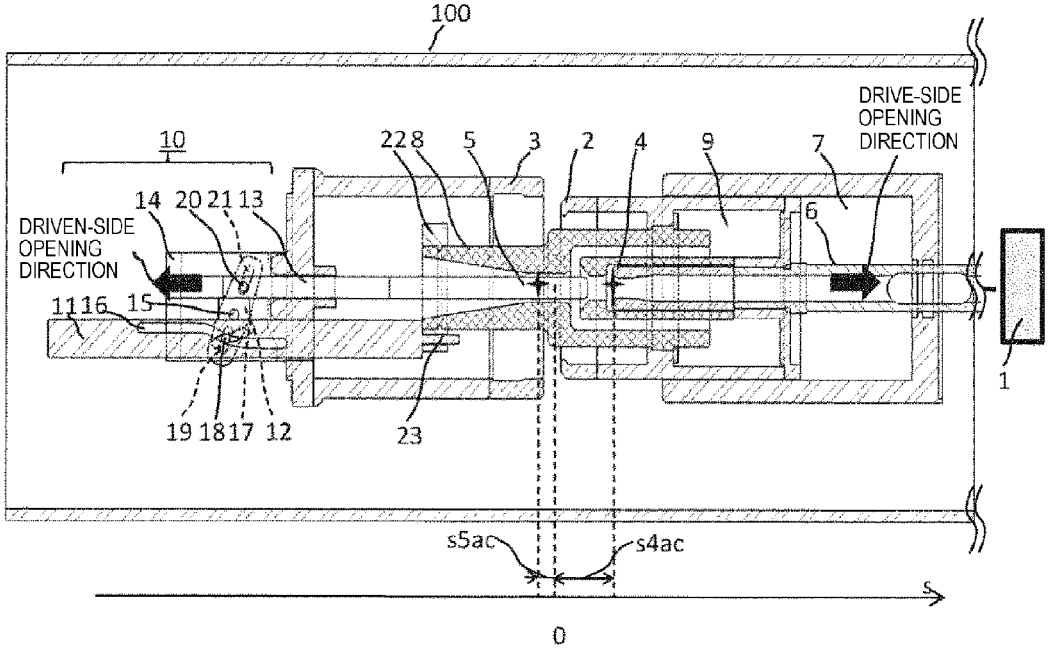

[FIG. 7]
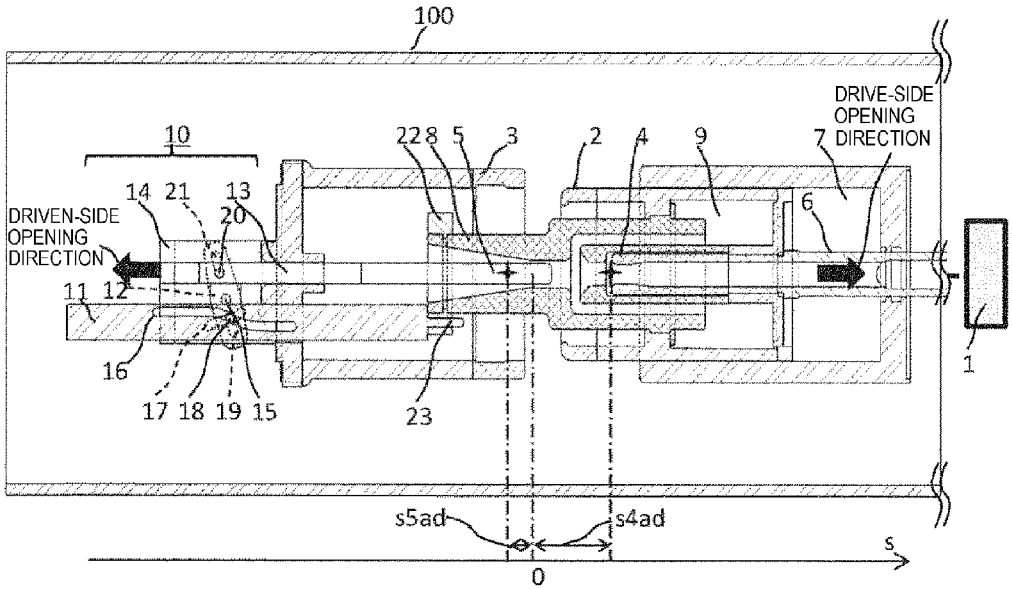
[FIG. 8]
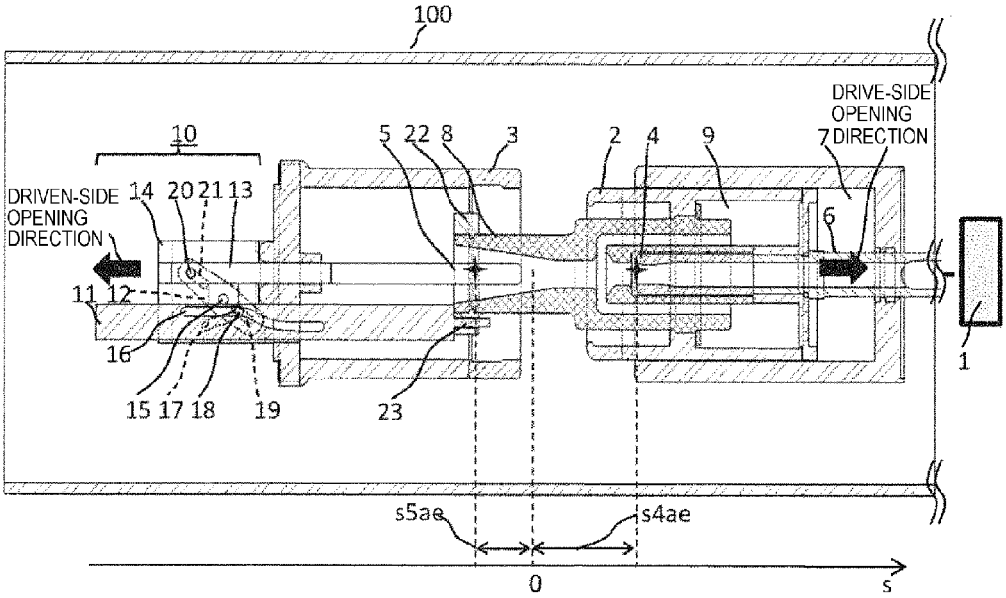

[FIG. 9]
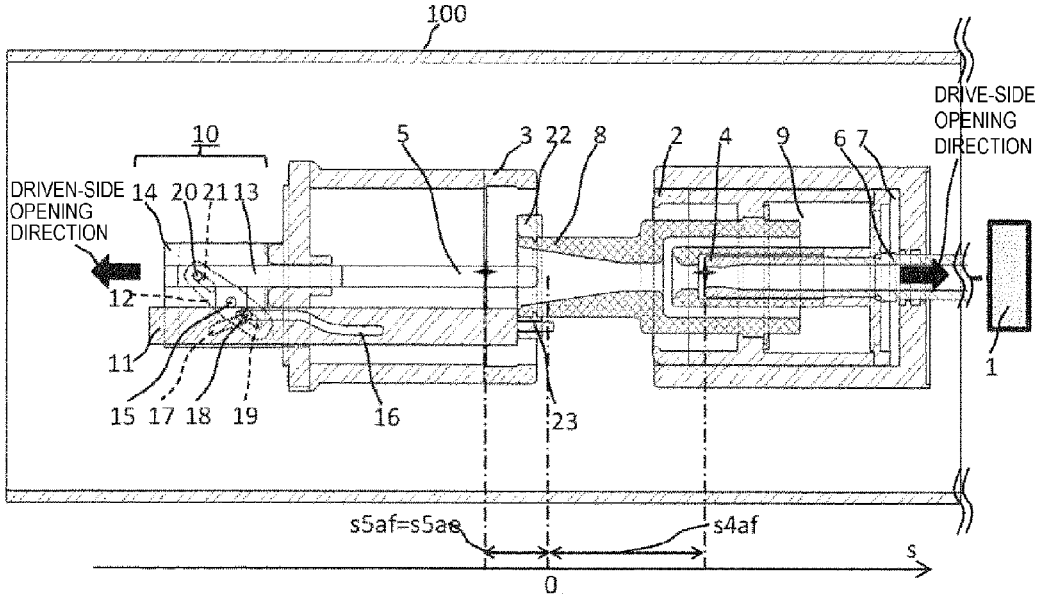
[FIG. 10]
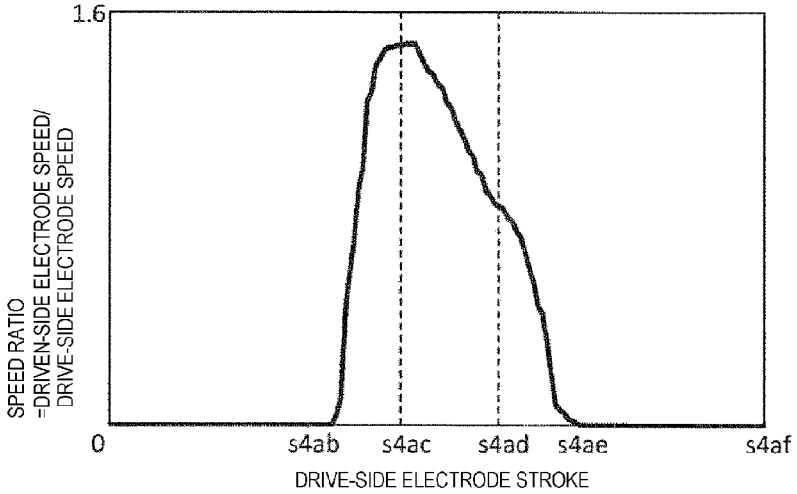

GAS CIRCUIT BREAKER

TECHNICAL FIELD

The present invention relates to a gas circuit breaker adopting a bidirectional driving mechanism driving electrodes in directions opposite to each other.

BACKGROUND ART

As a gas circuit breaker used for a high-voltage power system, a so-called puffer type device is commonly used, which uses an increase in an extinguishing gas pressure during an opening operation and blows a compressed gas to an arc generated between electrodes to cut off electric current.

In order to improve cutoff performance of the puffer-type gas circuit breaker, a bidirectional driving system which drives a driven-side electrode which has been hitherto fixed in a direction opposite to a driving direction of a drive-side electrode is proposed.

For example, a system using a fork-shaped lever is proposed in Patent Literature 1. In this invention, the fork-shaped lever rotates when a pin interlocked with the drive-side movement contacts a concave portion of the fork, and the rotation is converted into reciprocating motion in directions of an opening/closing shaft, thereby driving a driven-side arc electrode in a direction opposite to a driving direction of a drive-side electrode. The lever maintains the position and the driven-side arc electrode is stopped in a state where the pin is separated from the concave portion of the fork.

An object of the invention is to move the driven side in a time domain necessary for cutting off electric current with the minimum driving force efficiently.

Moreover, a bidirectional driving system using a groove cam is proposed in Patent Literature 2. In the invention, a pin moves in the groove cam in accordance with a drive-side movement, and a driven-side arc electrode connected to the cam is driven in a direction opposite to a drive-side electrode by rotating the cam. A desired speed radio between the driven-side arc electrode and the drive-side electrode can be realized by forming the groove cam in an arbitrary shape.

CITATION LIST

Patent Literature

Patent Literature 1: U.S. Pat. No. 6,271,494
Patent Literature 2: JP-A-2003-109480

SUMMARY OF INVENTION

Technical Problem

However, there is a problem that it is difficult to arbitrarily set the driven-side speed as the shape of the fork-shaped lever described in Patent Literature 1 is formed only by a straight-line part and an arc part. There is further a danger that excessive force is applied to the fork-shaped lever as the pin contacts the concave portion of the fork-shaped lever at every opening/closing operation.

Although the driven-side speed can be arbitrarily set by the groove cam in Patent Literature 2, it is difficult to limit the driven-side movement in a desired time domain as the groove cam has an approximately arc shape and the driven side constantly moves with respect to the drive-side movement. Moreover, there is a problem that the device is increased in size as the groove cam has the approximately arc shape.

Solution to Problem

In order to solve the above problems, a gas circuit breaker according to the invention includes a drive-side electrode and a driven-side electrode provided so as to face each other inside a closed tank 100, in which the drive-side electrode includes a drive-side main electrode 2 and a drive-side arc electrode 4, the driven-side electrode has a driven-side main electrode 3 and a driven-side arc electrode 5, the drive-side arc electrode 4 is connected to an actuator and the driven-side arc electrode 5 is coupled to a bidirectional driving mechanism 10.

The bidirectional driving mechanism 10 includes a drive-side linkage rod 11 receiving a driving force from the drive-side electrode, a driven-side linkage rod 13 connected to the driven-side arc electrode 5, two levers 12 moving the driven-side linkage rod 13 in an opposite direction with respect to the motion of the drive-side linkage rod 11, and a guide 14 inside which the drive-side linkage rod 11 and the driven-side linkage rod 13 move.

The two levers 12 are arranged on both sides of the guide 14 and fixed to each other so as to rotate freely by a lever fixing member 15, a moveable pin 18 penetrates through a first groove cam 16 possessed by the drive-side linkage rod 11, a second cam 17 possessed by the guide 14 and third cams 19 possessed by the two levers 12 respectively so as to rotate freely, and a pin 20 for connecting between the two levers 12 and the driven-side linkage rod 13 at an opposite position to the moveable pin 18 with the lever fixing member 15 interposed therebetween in the two levers 12.

Advantageous Effects of Invention

According to the invention, it is possible to realize the groove cam shape in which energy of the actuator can be minimum while securing cutoff performance, and operation energy can be reduced as compared with a related-art bidirectional driving system. Moreover, the reliable and space-saving bidirectional driving mechanism can be realized.

BRIEF DESCRIPTION OF DRAWINGS

FIG. 1 is a detailed view of a bidirectional drive mechanism of a gas circuit breaker according to an embodiment of the invention.

FIG. 2 is a view showing a closed state of the gas circuit breaker according to the embodiment of the invention.

FIG. 3 is an exploded perspective view of the gas circuit breaker according to the embodiment of the invention.

FIG. 4 is a view showing stroke characteristics of the gas circuit breaker according to the embodiment of the invention.

FIG. 5 is a view showing a state just before the movement of a driven-side arc electrode during opening of the gas circuit breaker according to the embodiment of the invention.

FIG. 6 is a view showing a state where a moveable pin enters a connecting portion of a first groove cam and the driven-side arc electrode just starts moving during the opening of the gas circuit breaker according to the embodiment of the invention.

FIG. 7 is a view showing a state before the moveable pin passes through the connecting portion of the first groove cam and where the movement of the driven-side arc electrode is about to end during the opening of the gas circuit breaker according to the embodiment of the invention.

FIG. 8 is a view showing a state when the movement of the driven-side arc electrode ends during the opening of the gas circuit breaker according to the embodiment of the invention.

FIG. 9 is a view showing an opened state of the gas circuit breaker according to the embodiment of the invention.

FIG. 10 is a chart showing a speed ratio between a drive-side arc electrode 4 and the driven-side arc electrode 5 in the gas circuit breaker according to the embodiment of the invention.

DESCRIPTION OF EMBODIMENTS

Hereinafter, a gas circuit breaker according to embodiments of the invention will be explained with reference to the drawings. The followings are just embodiments and do not intend to limit the contents of the invention to the following specific examples. The invention itself can be achieved by various states in conformity with the contents described in claims. In the following embodiments, a circuit breaker including a mechanical compression chamber and a thermal expansion chamber will be explained as an example, and the present application of the invention can be also applied to a circuit breaker including only the mechanical compression chamber.

Embodiment 1

FIG. 2 shows an input state of a gas circuit breaker according to an embodiment of the invention.

A drive electrode and a driven electrode are coaxially provided so as to face each other inside a closed tank 100. The drive-side electrode includes a drive-side main electrode 2 and a drive-side arc electrode 4, and the driven-side electrode includes a driven-side main electrode 3 and a driven-side arc electrode 5.

An actuator 1 is provided adjacent to the closed tank 100. A shaft 6 is connected to the actuator 1 and the drive-side arc electrode 4 is provided at a tip of the shaft 6. The shaft 6 and the drive-side arc electrode 4 are provided so as to penetrate a mechanical compressed chamber 7 and a thermal expansion chamber 9.

On a breaker portion's side in the thermal expansion chamber 9, the drive-side main electrode 2 and a nozzle 8 are provided. The driven-side arc electrode 5 is provided coaxially with the drive-side arc electrode 4 so as to face each other. One end of the driven-side arc electrode 5 and a tip portion of the nozzle 8 are connected to a bidirectional driving mechanism 10.

As shown in FIG. 2, the gas circuit breaker is installed in a position where the drive-side main electrode 2 and the driven-side main electrode 3 are electrically connected by a hydraulic pressure of the actuator 1 or a drive source by a spring in the input state, which forms a circuit of the power system in a normal state.

When cutting off short-circuit current due to lightning and so on, the actuator 1 is driven in an opening direction to separate the drive-side main electrode 2 from the driven-side main electrode 3 through the shaft 6. At that time, an arc is generated between the drive-side arc electrode 4 and the driven-side arc electrode 5. The arc is distinguished by mechanically blowing an extinguishing gas by the mechanical compressed chamber 7 and blowing the extinguishing gas utilizing arc heat by the thermal expansion chamber 9, thereby cutting off electric current.

In order to reduce operational energy of the puffer-type gas circuit breaker, the bidirectional driving mechanism 10 which drives the driven-side arc electrode which has been hitherto fixed in a direction opposite to the driving direction of the drive-side electrode is provided. Hereinafter, a bidirectional driving system according to the embodiment of the invention will be explained with reference to FIG. 1 and FIG. 3.

The bidirectional driving mechanism 10 according to the invention is configured by connecting a driven-side linkage rod 13 and a drive-side linkage rod 11 by levers 12 provided in a guide 14 so as to rotate freely while holding these rods so as to move freely in a cutoff operation direction by the guide 14 as shown in FIG. 1 and FIG. 3.

A first groove cam 16 is cut in the drive-side linkage rod 11, which is configured by a second straight line portion 16C, a connecting portion 16B and a first straight line portion 16A seen from the actuator's side. The first straight line portion 16A and the second straight line portion 16C are provided on different axes from each other, and the connecting portion 16B is provided therebetween. A displacement width of the first groove cam 16 in the vertical direction is set so as to fall within a displacement width of a second groove cam 17 in the vertical direction and a displacement with of a third groove cam 19 in the vertical direction. The shape of the connecting portion 16B may be arbitrarily designed in accordance with operation characteristics of the breaker portion, and for example, a curved line or a straight line may be considered.

The displacement of the drive-side linkage rod 11 in the vertical direction is limited by a groove provided in the guide 14, which can move only in a horizontal direction with respect to the operation axis of the breaker portion.

The second groove cam 17 having the same width as the width of the first groove cam 16 in the vertical direction and formed by, for example, a curved line is cut in the guide 14 as shown in FIG. 1. The shape of the second groove cam 17 is not limited to the curved line and can be appropriately changed in accordance with cutoff operation characteristics. The first groove cam 16 and the second groove cam 17 have a stacked structure in a perpendicular direction on the paper, which are connected so as to move freely with a moveable pin 18 at an overlapping part of both groove cams (see FIG. 3).

Moreover, the moveable pin 18 is inserted into the third groove cams 19 cut in the levers 12, and the levers 12 rotate around a lever fixing pin 15 as a rotation axis. At this time, the moveable pin 18 moves while rolling in the second groove cam 17 in one direction when moving on the connecting portion 16B of the first groove cam. Due to the movement of the moveable pin 18 in one direction, a force acts on one side of an inner wall of the third groove cam 19 and a rotation direction of the lever 12 is regulated. The shape of the third groove cam 19 is not particularly limited and can be appropriately changed in accordance with cutoff operation characteristics.

Due to the rotating motion, lever driven-side guide grooves 21 cut in the levers 12 transmit the power to a driven-side moving pin 20 attached to the driven-side linkage rod 13, thereby driving the driven-side linkage rod 13 connecting to the driven-side arc electrode 5 to the direction opposite to the drive-side linkage rod 11.

An interval dl between the drive-side linkage rod 11 and the driven-side linkage rod 13 is determined by the difference between an outer diameter of the tip of the nozzle 8 and a diameter of the driven-side arc electrode.

An arm length La1 on the drive side and an arm length Lb1 on the driven side change in accordance with an angle of the lever 12, however, La1<Lb1 at any angle. In this case, the force for moving the driven side is increased as compared with a case of Lb1<La1, however, the force does not particularly matter as a weight of the driven-side arc electrode is drastically smaller than a weight on the drive side. As the light driven-side arc electrode can be moved quickly with respect to the drive side, necessary relative speed can be secured with the minimum operating force.

The connection between the bidirectional driving mechanism 10 and the drive side has a structure in which, for example, a fastening ring 22 is attached to the nozzle 8, a hole through which a tip portion of the drive-side linkage rod 11 penetrates is provided in the fastening ring 22 and a drive-side fastening screw 23 is fastened by a nut.

FIG. 3 shows an exploded perspective view of the bidirectional driving mechanism according to the embodiment of the invention. Two levers 12 having the same shape are attached to outer sides of the guide 14. In the operation of the bidirectional driving mechanism according to the embodiment, a load acting on the levers 12 is the highest, a wall thickness and a width of each lever can be increased and the stress of the levers 12 can be alleviated by installing the levers 12 on the outer sides of the guide 14 where there is no constraint in space.

Another reason for providing the levers 12 on the outer sides is for continuously securing sliding regions 24 with respect to the guide 14 in the drive-side linkage rod 11. When the levers 12 are installed on inner sides, the levers 12 interfere with the sliding regions 24 due to the rotation of the levers 12. Accordingly, part of the sliding regions 24 has to be cut, and it becomes difficult to secure the sliding with respect to the drive-side linkage rod 11 in the entire region. When a force in the vertical direction generated by the cutoff operation acts from the moveable pin 18 at places other than the sliding regions 24, it is difficult to hold the force and large bending force acts. The levers 12 are provided on outer sides for securing the sliding regions 24 in the entire region for suppressing the force.

The moveable pin 18 penetrates the second groove cam 17 in the guide 14, the first groove cam 16 in the drive-side linkage rod 11 and the third groove cams 19 in the levers 12. The moveable pin 18 is not fixed to any part and can move in respective grooves freely.

The driven-side moving pin 20 penetrates the levers 12 (lever driven-side guide grooves 21) and the driven-side linkage rod 13 (a driven-side linkage rod hole 30). In this case, a hole 25 in which the driven-side moving pin 20 moves is provided in the guide 14.

Not-shown fixing rings are attached to both ends of the lever fixing pin 15 so as not to fall from the guide 14.

Concerning the moveable pin 18 and the driven-side moving pin 20, hexagon heads are provided in one ends, and a moveable pin fastening screw 26 and a driven-side moving pin fastening screw 28 cut in the other ends are fastened by a moveable pin fixing nut 27 and a driven-side moving pin fixing nut 29 are fastened so as not to fall from the guide 14. In this case, a length in a cylindrical portion in the moveable pin 18 is set to be equal to or more than a thickness of the levers 12 and the guide 14 in a stacked direction so that the moveable pin 18 can move in the groove cam freely.

The lever fixing pin 15 has the structure of providing the fixing rings as the pin 15 constantly stands still during an operation period and is not necessary to be fastened firmly by a bolt and a nut. However, it is also preferable that the lever fixing pin 15 is fastened by the bolt and the nut in the same manner as the driven-side moving pin 20.

The driven-side moving pin 20 penetrates the lever driven-side guide groove 21 and the driven-side linkage rod hole 30, and it is also preferable to adopt a structure where round holes are provided in the levers 12 and a long hole is provided in the driven-side linkage rod 13.

Hereinafter, opening operations in respective process states will be explained with reference to FIG. 4 to FIG. 10.

FIG. 4 is a chart in which time is plotted on the horizontal axis, and a drive-side electrode stroke and a driven-side electrode stroke are plotted on the vertical axis.

A time "a" represents an opening start time and a time "b" represents a time just before the movement of the driven-side arc electrode 5 (a state of FIG. 5).

A time "c" represents a state where the moveable pin 18 enters the connecting portion 16B of the first groove cam 16 (a state of FIG. 6), namely, a time when the driven-side arc electrode 5 just starts moving.

A time "d" represents a time before the moveable pin 18 passes through the connecting portion 16B of the first groove cam and at which the movement of the driven-side arc electrode 5 is about to end (a state of FIG. 7).

A time "e" represents a time when the movement of the driven-side arc electrode 5 ends (a state of FIG. 8). A time "f" represents a time when the drive-side operation is completed to reach an opened state (a state of FIG. 9).

Concerning strokes of both electrodes at respective times, for example, a stroke from the time "a" to the time "b" of the drive-side arc electrode 4 is expressed as "s4*ab*".

FIG. 5 is a view showing the state just before the movement of the driven-side arc electrode 5. The strokes from the time "a" to the time "b" are "s4*ab* (≠0)" in the drive-side arc electrode 4 and "s5*ab* (=0")" in the driven-side arc electrode 5, namely, the driven-side arc electrode 5 stands still.

That is, the state where the driven-side arc electrode 5 stands still is realized while the straight line portion of the second straight line portion 16C of the first groove cam passes through the moveable pin 18 (hereinafter the state is referred to as an intermittent driving). In other words, the driven side can be moved only in an arbitrary time domain by adjusting the length of the second straight line portion 16C.

FIG. 6 is a view showing the state where the moveable pin 18 enters the connecting portion 16B of the first groove cam and the driven-side arc electrode 5 just starts moving. Strokes during the state from the time "a" to the time "c" are "s4*ac*" (>s4*ab*)" in the drive-side arc electrode 4 and "s5*ac* (>s5*ab*)" in the driven-side arc electrode 5, namely, both electrodes are moving. At this time, the moveable pin 18 enters the connecting portion 16B of the first groove cam 16 and moves simultaneously in one direction in the second groove cam 17 and the third groove cams 19.

FIG. 7 is a view showing the state before the moveable pin 18 passes through the connecting portion 16B of the first groove cam 16 and where the movement of the driven-side arc electrode 5 is about to end. Strokes during the state from the time "a" to the time "d" are "s4*ad*" (>s4*ac*)" in the drive-side arc electrode 4 and "s5*ad* (>s5*ac*)" in the driven-side arc electrode 5, namely, both electrodes are moving. At this time, the moveable pin 18 moves in the connecting portion 16B of the first groove cam 16 and simultaneously moves in the second groove cam 17 and the third groove cams 19 in one direction.

FIG. 8 is a view showing the state when the movement of the driven-side arc electrode 5 ends. Strokes during the state from the time "a" to the time "e" are "s4*ae*" (>s4*ad*)" in the drive-side arc electrode 4 and "s5*ae* (>s5*ad*)" in the driven-side arc electrode 5, namely, both electrodes are moving. At this time, the moveable pin 18 enters the first straight portion 16A of the first groove cam and simultaneously moves in the second groove cam 17 and the third groove cams 19 in one direction.

FIG. 9 is a view showing the opened state. Strokes during the state from the time "a" to the time "f" are "s4*af*" (>s4*ae*)" in the drive-side arc electrode 4 and "s5*af*" (>s5*ae*)" in the driven-side arc electrode 5, namely, the driven-side arc electrode 5 stands still. The intermittent driving state in which the driven-side arc electrode 5 stands still is realized while the straight line portion of the first groove cam 16 passes through the moveable pin 18.

After the opening operation is started, the moveable pin 18 moves in the second straight portion 16C and the levers 12 stand still until reaching the state of FIG. 5. In the states of FIGS. 6 and 7, the moveable 18 moves in the connecting portion 16B and the levers 12 rotate around the lever fixing pin 15 as a fulcrum. In states of FIGS. 8 and 9, the moveable pin 18 moves in the first straight line portion 16A and the lever 12 stands still.

As shown in FIGS. 6 and 7, when the moveable pin 18 moves on the connecting portion 16B, the levers 12 rotate around the lever fixing pin 15 as the fulcrum while the movable pin 18 moves in the second groove cam 17 and the third groove cams 19 respectively in one direction.

In the opening operation (FIG. 5 to FIG. 9), the moveable pin 18 moves in the second straight line portion 16C, the connecting portion 16B and the first straight line portion 16A in one direction. On the other hand, in the input operation (FIG. 9 to FIG. 5), the moveable pin 18 moves in the first straight line portion 16A, the connecting portion 16B and the second straight line portion 16C in one direction.

As described above, the movable pin 18 maintains the position of the levers 12 in the connecting portion 16B of the first groove cam by the second groove cam 17, thereby rotating the levers 12 in one direction and driving the driven-side arc electrode 5 in the direction opposite to the drive-side arc electrode 4, as a result, the motion of the moveable pin 18 is regulated in the first straight line portion 16A of the first groove cam by the second groove cam 17 and the third groove cams 19, and the rotation of the levers 12 is stopped. Accordingly, the intermittent driving state in which the driven-side arc electrode 5 stands still is realized.

In the present embodiment, a space-saving bidirectional driving mechanism can be realized by staking the first groove cam 16 and the second groove cam 17 in the axial direction of the moveable pin 18 as shown in FIG. 3. Moreover, the excessive force acting on the moveable pin 18 can be alleviated as the moveable pin 18 is not fixed to any portion, therefore, a reliable bidirectional driving mechanism can be realized.

Furthermore, the curved line portion of the first groove cam has a high degree of freedom in design, design can be changed easily in accordance with models having different structures of the breaker portion and different cutoff systems, and the optimum shapes of the curved line which can secure cutoff performance can be designed. As the length and the region of the straight line portion can be set freely, the driven side can be moved only in an arbitrary time domain.

FIG. 10 is a chart in which the stroke of the drive-side arc electrode 4 is plotted in the horizontal axis and the speed ratio between the drive-side arc electrode 4 and the driven-side arc electrode 5 is plotted in the vertical axis. In the present embodiment, when the drive-side arc electrode 4 reaches the stroke "s4*ab*", the driven-side arc electrode 5 starts moving and the driven-side arc electrode 5 is stopped at "s4*ae*". The driven-side arc electrode 5 is accelerated from "s4*ab*" to "s4*ac*", and decelerated in two stages from "s4*ac*" to "s4*ad*" and from "s4*ad*" to "s4*ae*". This is for rapidly accelerating the driven-side arc electrode 5 from the time "b" (see FIG. 4) when the driven-side arc electrode 5 passes through the drive-side arc electrode 4 to extend the distance between electrodes in a short period of time.

The above operation is especially effective for small capacitive current breaking. In the small capacitive current breaking, it is necessary that dielectric breakdown voltages between electrodes at each time of breaking exceed a recovery voltage. This is because it is necessary to gain the distance between electrodes as long as possible in a short period of time as the dielectric breakdown voltage between electrodes depends on the distance between electrodes at each time.

In the present embodiment, the groove cam shape in the bidirectional driving mechanism capable of realizing stroke characteristics necessary for small capacitive current breaking is shown, however, optimum stroke characteristics exist with respect to various breaking duties, which can be realized by changing the shape of the connecting portion 16 formed by an arbitrary curved line of the present embodiment.

It is also possible to change the speed ratio of the driven-side operation with respect to the drive-side operation by adjusting positional relationship of the first straight line portion 16A, the second straight line portion 16C and the connecting portion 16B of the first groove cam, the second groove cam 17 and the third groove cams 19.

REFERENCE SIGNS LIST

1 . . . actuator, 2 . . . drive-side main electrode, 3 . . . driven-side main electrode, 4 . . . driven-side arc electrode, 5 . . . driven-side arc electrode, 6 . . . shaft, 7 . . . mechanical compression chamber, 8 . . . nozzle, 9 . . . thermal expansion chamber, 10 . . . bidirectional driving mechanism, 11 . . . drive-side linkage rod, 12 . . . lever, 13 . . . driven-side linkage rod, 14 . . . guide, 15 . . . lever fixing pin, 16 first groove cam, 16A . . . first straight line portion, 16B . . . connecting portion, 16C . . . second straight line portion, 17 . . . second groove cam, 18 . . . moveable pin, 19 . . . third groove cam, 20 . . . driven-side moving pin, 21 lever driven-side guide groove, 22 . . . fastening ring, 23 . . . drive-side fastening screw, 24 . . . sliding region, 25 . . . hole, 26 . . . moveable pin fastening screw, 27 . . . moveable pin fixing nut, 28 . . . driven-side moving pin fastening screw, 29 . . . driven-side moving pin fixing nut, 30 . . . driven-side linkage rod hole

The invention claimed is:

1. A gas circuit breaker comprising:

a drive-side electrode; and a driven-side electrode which are provided so as to face each other inside a closed tank, wherein the drive-side electrode includes a drive-side main electrode and a drive-side arc electrode, the driven-side electrode has a driven-side main electrode and a driven-side arc electrode, the drive-side arc electrode is connected to an actuator and the driven-side arc electrode is coupled to a bidirectional driving mechanism, the bidirectional driving mechanism includes a drive-side linkage rod receiving a driving force from the drive-side electrode, a driven-side linkage rod connected to the driven-side arc electrode, two levers moving the driven-side linkage rod in an opposite direction with respect to a motion of the drive-side linkage rod, and a guide inside which the drive-side linkage rod and the driven-side linkage rod move, the two levers are arranged on both sides of the guide and fixed to each other so as to rotate freely by a lever fixing member, a moveable pin penetrates through a first groove cam possessed by the drive-side linkage rod, a second cam possessed by the guide and third cams possessed by the two levers respectively so as to rotate freely, and a connecting member for connecting between the two levers and the driven-side linkage rod at an opposite position of the moveable pin with the lever fixing member interposed therebetween in the two levers.

2. The gas circuit breaker according to claim 1, wherein the moveable pin moves in the first groove cam, a second groove cam and third groove cams respectively by a movement of the driven-side linkage rod, thereby rotating the two levers around the lever fixing member, driving the driven-side linkage rod in a direction opposite to the drive-side linkage rod, and driving the driven-side arc electrode connecting to the driven-side linkage rod in a direction opposite to the drive-side arc electrode of the drive-side electrode connecting to the drive-side linkage rod.

3. The gas circuit breaker according to claim 2, wherein the first groove cam is configured by a first straight line portion, a second straight line portion provided on a different axial line from the first straight line portion and a connecting portion connecting between the first straight line portion and the second straight line portion, and a displacement width of the first groove cam in a vertical direction is set so as to fall within a displacement width of the second groove cam in the vertical direction and a displacement width of the third groove cam in the vertical direction.

4. The gas circuit breaker according to claim 3, wherein the two levers stand still when the moveable pin moves in the first straight line portion and the second straight line portion, and the two levers rotate around the lever fixing member as a fulcrum when the moveable pin moves in the connecting portion.

5. The gas circuit breaker according to claim 4, wherein the moveable pin moves in the second groove cam and the third groove cams respectively in one direction when the moveable pin moves in the connecting portion.

6. The gas circuit breaker according to claim 4, wherein the moveable pin moves in one direction in order of the second straight line portion, the connecting portion and the first connecting portion in an opening operation, and the moveable pin moves in one direction in order of the first connecting portion, the connecting portion and the second straight line portion in a closing operation.

7. The gas circuit breaker according to claim 3, wherein the moveable pin moves in the second groove cam and the third groove cams respectively in one direction when the moveable pin moves in the connecting portion.

8. The gas circuit breaker according to claim 7, wherein the moveable pin moves in one direction in order of the second straight line portion, the connecting portion and the first connecting portion in an opening operation, and the moveable pin moves in one direction in order of the first connecting portion, the connecting portion and the second straight line portion in a closing operation.

9. The gas circuit breaker according to claim 3, wherein the moveable pin moves in one direction in order of the second straight line portion, the connecting portion and the first connecting portion in an opening operation, and the moveable pin moves in one direction in order of the first connecting portion, the connecting portion and the second straight line portion in a closing operation.

10. The gas circuit breaker according to claim 3, wherein positional relationship of the first straight line portion, the second straight line portion and the connecting portion of the first groove cam, the second groove cam and the third groove cams is determined by a speed ratio of the driven-side operation with respect to the drive-side operation.

* * * * *